United States Patent [19]

Dwinell

[11] 4,236,629

[45] Dec. 2, 1980

[54] NESTABLE POURING SPOUT ASSEMBLY

[75] Inventor: Davis B. Dwinell, Warren, N.J.

[73] Assignee: American Flange & Manufacturing Co. Inc., Linden, N.J.

[21] Appl. No.: 947,942

[22] Filed: Oct. 2, 1978

[51] Int. Cl.[3] ..... B65D 25/44

[52] U.S. Cl. ..... 222/529; 222/530; 222/551; 220/85 SP

[58] Field of Search ..... 222/527–532, 222/537, 541, 525, 551; 220/85 SP

[56] References Cited

U.S. PATENT DOCUMENTS

| | | | |
|---|---|---|---|
| 2,565,699 | 8/1951 | Rieke | 222/529 |
| 2,895,654 | 7/1959 | Rieke | 222/530 X |
| 3,203,665 | 8/1965 | Grant et al. | 220/855 P X |
| 3,250,428 | 5/1966 | Rieke | 222/538 X |
| 3,613,966 | 10/1971 | Summers | 222/529 |
| 4,076,151 | 2/1978 | Littlefield | 222/541 X |
| 4,128,192 | 12/1978 | Coryell | 222/541 X |

FOREIGN PATENT DOCUMENTS

| | | | |
|---|---|---|---|
| 1924824 | 3/1978 | Fed. Rep. of Germany | 222/529 |

*Primary Examiner*—F. J. Bartuska

[57] ABSTRACT

A nestable pouring spout assembly for dispensing liquid products from cans and pails. A molded plastic spout has in extended pouring position an enlarged flexible lower wall portion joined to a relatively rigid externally threaded upper wall portion closed off by an imperforate sealing diaphragm. A peripheral sealing channel is disposed about the base of the lower wall portion for securing to a container wall opening neck by means of an overlying metal crimping ring. The upper wall portion receives an internally threaded reclosing cap which is cooperatively engaged within the confines of the crimping ring when the spout is in stored position with the upper wall concentrically nested within the lower wall. Gripping bails integrally formed on the reclosing cap facilitate lifting the spout to raised pouring position by reversing the lower wall portion with respect to the sealing channel from a downwardly extending position to an upwardly extending position.

4 Claims, 5 Drawing Figures

NESTABLE POURING SPOUT ASSEMBLY

BACKGROUND OF THE INVENTION

One type of liquid dispensing closure commonly found on industrial size containers such as five gallon cans and pails consists of a flexible plastic pouring spout which is nested within the confines of the container during storage and pulled to an upstanding extended position for pouring. This known spout is formed with an enlarged relatively flexible lower wall joined to a more rigid upper wall of somewhat smaller diameter which terminates in a pouring opening and has an external screw thread therearound for reception of a screw cap. The enlarged lower wall is secured to a container opening by means of a metal crimping ring so that in stored position the upper wall nests concentrically within the lower wall. Gripping bails on the screw cap enable lifting the spout, causing the flexible lower portion to unfold upon itself and reverse its inward extension to an outward extension whereupon the spout assumes a fully extended pouring position.

While the above described flexible spout concept has without question become widely accepted, certain deficiencies exist suggesting the need for improvement. One such deficiency concerns the relative ease with which the spout can be readied for pouring and the container contents dispensed. Those prior art flexible spouts in common use, as a general rule, are difficult to grip and raise to extended pouring position, particularly with a gloved hand. Moreover, they require the rather cumbersome removal of an overlying metal cap which is inadequate to prevent the entry of dirt and moisture onto the retracted or nested spout. The desirability for complete container drainage, particularly in the agricultural chemical field, has also prompted concern for the mannner in which pail closure fittings assist in having the container completely emptied before discarding.

SUMMARY OF THE INVENTION

The invention is directed to a flexible pouring spout assembly for dispensing liquid products from containers.

The above mentioned deficiencies are effectively overcome by the invention in disclosing an improved crimped on nestable pouring spout of the type having a flexible sidewall which reversibly unfolds upon itself as the spout is urged from a retracted stored position to an extended pouring position. The configuration of the spout base is such that in raised or fully extended position, the residue of fluid retained in the emptied container due to the spout securing joint is substantially minimized. The invention spout incorporates an improved easy access screw cap for reclosing the pour opening and which, in addition, completely closes off the annular void formed between the spout neck in retracted position and the metal crimping ring. The invention cap is further provided with a pair of enlarged lifting bails disposed about the cap periphery in stored position to facilitate easy spout access for pouring.

It is accordingly a principal object of the invention to provide a new and improved nestable pouring spout assembly for containers including a flexible or collapsible wall plastic spout and a plastic screw cap.

Another object is to provide an improved pouring spout adapted to reversably nest within itself in retracted position provided with an improved easy access screw cap in threaded engagement with spout neck and constructed to tightly seal off the complete spout assembly in retracted position.

A further object is to provide a nestable pouring spout assembly wherein the spout container wall joint is formed to assist complete drainage of the container when emptied.

Other and more detailed objects will in part be obvious and in part pointed out as the description of the invention taken in conjunction with the accompanying drawing proceeds.

Figure 1:
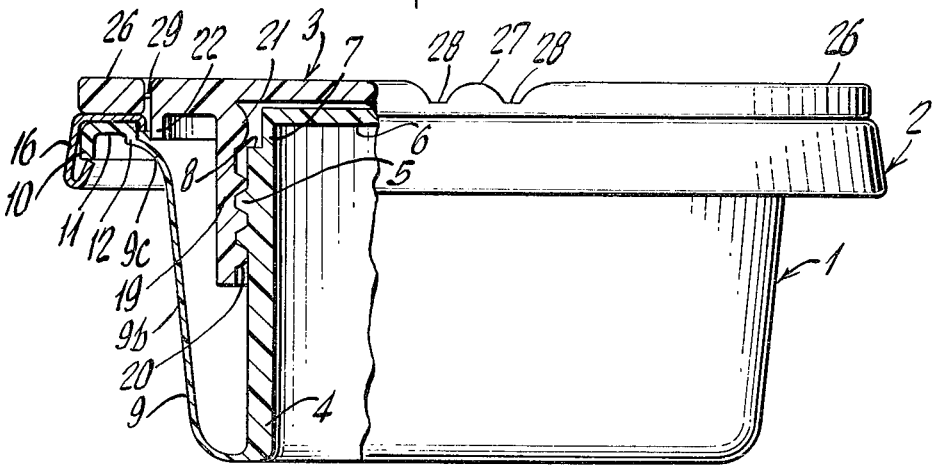
FIG. 1 is a part elevational part sectional view of the nestable pouring spout assembly in accordance with the invention.
Figure 3:
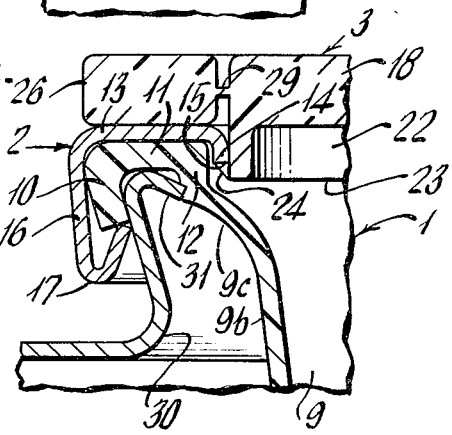
FIG. 3 is a fragmentary sectional view of the pouring spout assembly crimped onto a container opening neck.

The pouring spout assembly of the invention as shown in FIG. 1 consists of a nestable plastic spout 1, an annular metal crimping ring 2 and a plastic screw cap 3. The pouring spout 1, shown in retracted or nested position in FIG. 1, has a relatively rigid tubular inner wall portion 4 formed with an external thread formation 5 and closed at its uppermost end with a tamperproof sealing membrane 6. To facilitate cutting away of the membrane 6, the upper end of the wall portion 4 joins the membrane in a severable band 7 or reduced cross sectional thickness forming a circumferential exterior shoulder 8. The lower end of inner wall portion 4 is integrally connected to a relatively flexible outer wall portion 9 which initially curves radially outwardly and upwardly at **9*a* from the lowermost end of the wall portion 4. The wall portion 9 then extends upwardly at an angle, as indicated at 9*b*, flaring radially outwardly approximately 10 degrees from the vertical and terminating in a gradually outwardly curved portion 9*c*. The wall portion 9*c* is then joined to a peripheral sealing channel having an outer wall 10, a top wall 11 and an inner wall 12 which can be seen to be slightly shorter than the outer wall 10 in FIG. 3**.

The metal crimping ring 2 overlies the spout sealing channel and consists of a flat annular top wall 13 and a short depending inner wall 14 which partially confines the channel inner wall 12 terminating in a downwardly facing free edge 15. The sealing channel also has an elongated depending outer wall 16 terminating in a radially inwardly and upwardly curled bead 17 which underlies the lowermost end of the spout sealing channel outer wall 10.

The pouring spout cap 3, also molded of synthetic plastic, has a circumferentially enlarged disc-like top wall 18. An elongated cylindrical skirt 19 depends concentrically from the undersurface of the top wall 18 and is provided with an internal screw thread 20. A radially inwardly extending annular bead 21 is disposed on the interior surface of the cap skirt 19 immediately beneath the top wall 18. As clearly seen in FIGS. 1 and 3 the top wall 18 extends radially outwardly of the skirt 19 so as to overlie the void created between the spout inner wall portion 4 and the outer wall portion 9 when the spout is in nested or retracted position. A short depending lip 22 is formed about the cap top wall periphery terminating in a downwardly facing free edge 23. A series of four equally spaced retaining fingers 24 project radially outwardly from the lip 22 so as to underlie the lowermost free edge 15 of the ring inner wall 14. A pair of bails 26 are intergrally joined to the cap top wall by means of the connecting ears 27 with hinge grooves 28 of reduced vertical cross section on either side of the connecting ears to permit easy raising of the bails. In addition, the bails 26 are joined in flattened position to the periphery of the top wall 18 by a series of frangible connecting webs 29.

The above described respective parts are assembled by first inserting the sealing channel of the spout 1 within the metal crimping ring 2. The cap 3 is then threadedly engaged over the spout inner wall portion 4. At the termination of this threading operation, the retaining fingers 24 at the periphery of the cap top wall contact the inner wall 14 of the metal crimping ring causing the lip 22 to be deformed radially inwardly. Continued downward movement of the cap 3 causes the fingers 24 to snap radially outwardly again and tightly engage the inner wall free edge 15. In this manner the spout and cap are securely locked together in a compact assembly thus affording adequate protection against damage or disassembly during shipment and handling.

Figure 2:
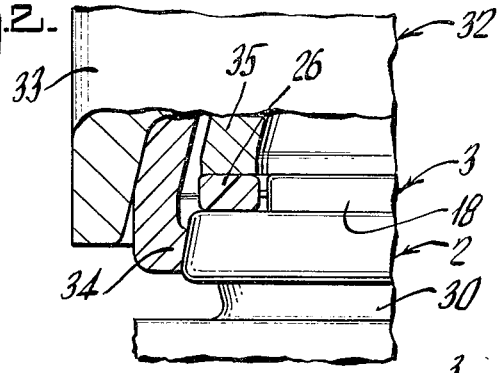
FIG. 2 is a part elevational part sectional view of the pouring spout assembly seated on a container opening and showing a portion of a crimping tool in operative position.

The head of the pail to which the spout assembly is applied is formed with an opening surrounded by an outwardly flared upstanding neck 30 terminating at its upper end in a radially inwardly extending flange 31. After completion of the filling operation the pouring spour assembly is simply dropped onto the opening whereupon the fitting automatically centers itself within the confines of the neck 30. The relatively straight wall portion **9*b* and the gradually curved portion 9*c* act as a pilot for properly locating and guiding the spout assembly within the opening so that the neck flange 31 is accurately seated within the spout sealing channel. Permanent securing of the spout assembly is then effected by means of a sealing tool 32 partially illustrated in FIG. 2 and seen to comprise a housing 33 within which is mounted a series of annularly arranged crimping jaws 34 and a central pressure pad 35. The sealing tool 32 is seated on the spout assembly with the central pressure pad supported on the bails 26 which in turn bear against the upper wall of the metal crimping ring. Actuation of the sealing tool such as by conventional lever arms (not shown) causes the jaws 34 to contract and deform the skirt bead 17 radially inwardly against the opening neck 30**.

The container is thus effectively sealed for shipping and storage. In the event of a minor pressure build-up within the container due to temperature variations, engagement of the gripping fingers underneath the crimping ring lip 14 will prevent the spout from pushing the cap upwardly. In addition a weather tight seal is formed between the cap lip 22 and the metal crimping ring which acts to prevent the entry of dirt and water within the annular nested spout void. It can also be seen that a degree of tamperproofing protection, in addition to that provided by the spout sealing membrane 6, is afforded by the ring and cap interlock coupled with the frangible webs 29 which would normally have to be broken to remove the cap 3.

Figure 4:
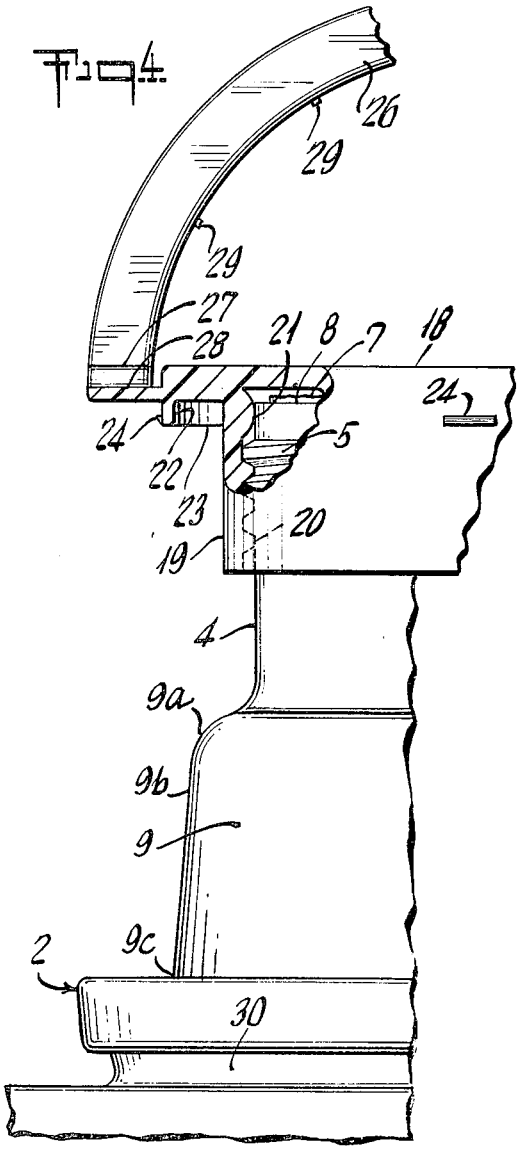
FIG. 4 is a part elevational part sectional view of the pouring spout assembly crimped onto a container wall opening and in extended pouring position.
Figure 5:
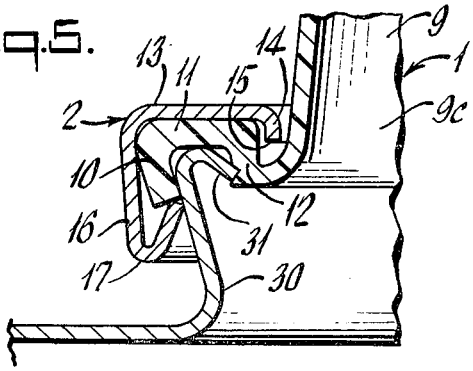
FIG. 5 is a view similar to FIG. 3 but with the spout in extended pouring position.

The sealed container is subsequently readied for dispensing by the user simply lifting the bails 26 causing the frangible webs 29 to fracture. With the bails deflected to upright position about the hinge points 27 they are easily gripped for lifting the cap and spout upwardly. During this initial upward movement, the cap retaining fingers 24 on the lip 22 are deformed radially inwardly permitting the cap to be released from the ring 3. Continued upward pulling raises the spout to extended pouring position as seen in FIG. 4 whereby the relatively flexible outer spout wall 9 unfolds and reverses its position so as to extend in an upward direction instead of downwardly with respect to the spout sealing channel. The cap 3 is then unscrewed from the spout and the tamperproof sealing membrane 6 cut away at the severable band 7. In the event the pail contents are only partially dispensed, the cap 3 is replaced on the threaded spout neck 4 causing the cap internal bead 21 to sealingly engage the exterior shoulder 8 for effective reclosing. Upon emptying of the container, complete drainage is aided by substantially eliminating the sump normally formed by the annular recess just inside the upstanding neck 30. As clearly seen in FIG. 5, the shortened inner wall 14 on the metal crimping ring allows for maximum extension of the spout wall 9 with respect to the sealing channel inner wall 10. This construction has the effect of reducing the depth of the sump underneath the neck flange 31 to a relatively minor portion of the overall neck height thus reducing the volume of liquid that might otherwise be prevented from draining out of the emptied pail.

Various other changes in or modifications of the pouring spout assembly and different imbodiments of the invention would suggest themselves to those skilled in the art and could be made without departing from the spirit or scope of the invention. For example the pouring spout might be secured to other container openings or without using a metal crimping ring. It is, accordingly, intended that all matter contained in the above description or shown in the accompanying drawing shall be interpreted as being illustrative and not in a limiting sense.

I claim:

1. In container closure construction a nestable integrally molded plastic pouring spout having a downwardly opening annular sealing channel peripherally disposed at one end, said sealing channel having a top wall, an outer wall, and an inner wall, a relatively flexible spout outer wall extending downwardly from said sealing channel inner wall, a relatively rigid exteriorly threaded spout inner wall connected to the lowermost end of said spout outer wall and concentrically nested therewithin with said spout in stored position, an imperforate sealing membrane closing off the distal end portion of said spout inner wall, an annular metal crimping ring at least partially overlying said top, inner, and outer walls of said spout sealing channel, an integrally molded plastic cap having a top and an internally threaded depending skirt threadedly engaged on said spout, said cap top extending circumferentially of said skirt so as to close off the annular void between said nested inner and outer walls, means depending from the periphery of said cap top tightly engaging said crimping ring with said spout in stored position and gripping means on said cap for raising said spout to extended pouring position by reversing said spout outer wall from a downwardly extending direction to an upwardly extending direction.

2. In container closure construction a nestable integrally molded plastic pouring spout having a downwardly opening annular sealing channel peripherally disposed at one end, said sealing channel having a top wall, an outer wall, and an inner wall, a relatively flexible spout outer wall extending downwardly from said sealing channel inner wall, a relatively rigid exteriorly threaded spout inner wall connected to the lowermost end of said spout outer wall and concentrically nested therewithin with said spout in stored position, an imperforate sealing membrane closing off the distal end portion of said spout inner wall, an annular metal crimping ring at least partially overlying said top, inner, and outer walls of said spout sealing channel, an integrally molded plastic cap having a top and an internally threaded depending skirt threadedly engaged on said spout, said cap top extending circumferentially of said skirt so as to close off the annular void between said nested inner and outer walls, the periphery of said cap top tightly engaging said crimping ring with said spout in stored position wherein the periphery of said cap top is interlockingly engaged with said crimping ring to prevent accidental extension of said spout due to internal pressure and gripping means on said cap for raising said spout to extended pouring position by reversing said spout outer wall from a downwardly extending direction to an upwardly extending direction.

3. In container closure construction a container wall opening surrounded by an upstanding inwardly curled neck, a nestable integrally molded plastic pouring spout having an annular sealing channel peripherally disposed at one end and seated on said upstanding neck, said sealing channel comprising an annular top wall, a shortened inner depending wall and an outer depending peripheral wall extending vertically below said channel inner wall, said spout including a relatively flexible outer wall extending downwardly from said sealing channel inner wall, a relatively rigid exteriorly threaded inner wall connected to the lowermost end of said outer wall and concentrically nested therewithin with said spout in stored position, an imperforate sealing membrane closing off the distal end portion of said spout inner wall, an annular metal crimping ring overlying said spout sealing channel, an integrally molded plastic cap having a top and an internally threaded depending skirt threadedly engaged on said spout and gripping means on said cap for raising said spout to extended pouring position by reversing said spout outer wall from a downwardly extending direction to an upwardly extending direction, the lowermost extent of said outer spout wall in pouring position lying in a horizontal plane displaced vertically above the lowermost end of said sealing channel outer wall closely adjacent the upper end of said neck and said neck inward curl terminating in a horizontal plane displaced vertically below the radial inward extend of said crimping ring so as to expose substantially the entire interior surface of said container wall upstanding neck below said inward curl and facilitate complete drainage of the container.

4. In container closure construction a nestable integrally molded plastic pouring spout having an annular sealing channel peripherally disposed at one end, a relatively flexible outer wall extending downwardly from said sealing channel, a relatively rigid exteriorly threaded inner wall connected to the lowermost end of said outer wall and concentrically nested therewithin with said spout in stored position, an imperforate sealing membrane closing off the distal end portion of said spout inner wall, an integrally molded plastic cap having a top and an internally threaded depending skirt threadedly engaged on said spout, said cap top extending circumferentially of said skirt so as to close off the annular void between said nested inner and outer walls, retaining means disposed about the periphery of said cap top to prevent accidental extension of said spout due to internal pressure and gripping means on said cap for raising said spout to extended pouring position by reversing said spout outer wall from a downwardly extending direction to an upwardly extending direction wherein said gripping means surrounds said cap top and overlies said sealing channel with said spout in stored position.

* * * * *